United States Patent [19]
Reppas
[11] 4,318,195
[45] Mar. 9, 1982

[54] CONVERTIBLE FURNITURE UNIT

[76] Inventor: George S. Reppas, 1030 San Raymundo Rd., Hillsborough, Calif. 94010

[21] Appl. No.: 124,863

[22] Filed: Feb. 26, 1980

[51] Int. Cl.³ ..... A47B 85/00
[52] U.S. Cl. ..... 5/2 R; 5/164 R; 312/240
[58] Field of Search ..... 5/2 R, 3, 13, 24, 26, 5/164 R; 312/237, 240, 241

[56] References Cited

U.S. PATENT DOCUMENTS 3,387,110 6/1968 Vanhentenrijk ..... 5/3
3,550,167 12/1970 Bennett ..... 5/164 R
4,070,715 1/1978 Reppas ..... 5/2 R

*Primary Examiner*—Roy D. Frazier
*Assistant Examiner*—Alexander Grosz
*Attorney, Agent, or Firm*—Flehr, Hohbach, Test, Albritton & Herbert

[57] ABSTRACT

A convertible furniture unit having upper and lower platforms which are mounted for conjoint movement. In different embodiments the upper platform comprises a bed or table and the lower platform can be structures such as a desk, a credenza and desk, and the like. Releasable locks are provided for holding the upper platform in a prone position while the lower platform is lowered. When the locks are released a torsion bar arrangement automatically applies a yieldable force urging the upper platform toward the upright position as the lower platform is raised while maintaining a horizontal attitude. Terminal movement of the upper platform is cushioned by an air pocket created in the recess of an upright housing. The upper and lower platforms are held in a upright mode by over center positioning of the pivot points which permits the upper platform to be manually pulled downwardly to convert the unit to another mode.

6 Claims, 8 Drawing Figures

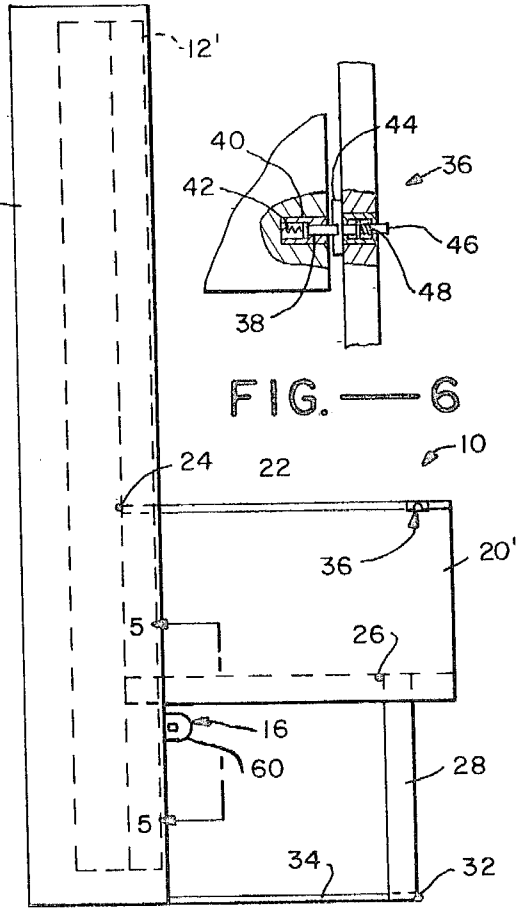
FIG. — 4
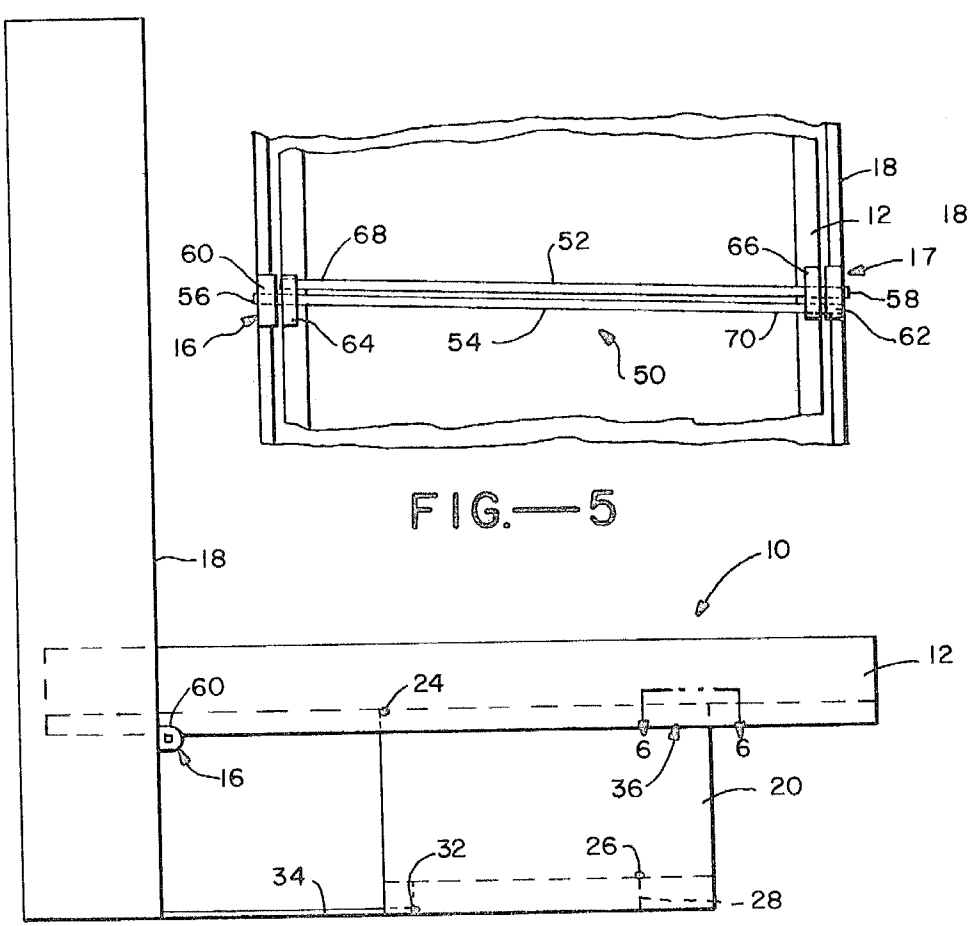
FIG. — 3
FIG. — 6
FIG. — 5

CONVERTIBLE FURNITURE UNIT

This invention relates in general to furniture which can be converted between different modes of use.

Heretofore furniture has been provided which is capable of converting between different modes of use, e.g. a sofa bed which converts between a sofa in one mode and a bed frame and mattress in another mode. U.S. Pat. No. 4,070,715 to George S. Reppas relates to a furniture unit which is convertible between a bed in one mode and a desk in another mode.

There are a number of disadvantages and limitations in certain of the previously known convertible furniture designs. A number of the prior designs are difficult to convert between the different modes in view of the size and weight of the units as well as the linkages and gears required for operation. Additionally, many of the prior designs are relatively complicated and expensive to construct. It would be desirable to provide an improved combination furniture unit which is relatively more easy to convert between the different modes and which is relatively simpler and less expensive in design.

It is a general object of the invention to provide a new and improved furniture unit which converts between different modes of operation.

Another object is to provide a convertible furniture unit of the type described in which the components are releasably locked or held in the different modes and which can be readily and easily operated between the modes.

Another object is to provide a convertible furniture unit of the type described which releasably locks the components in one mode and in which upon release the components are automatically moved to a second mode.

The invention in summary includes an upper platform which is coupled for conjoint movement with a lower platform. In different embodiments the upper platform can be either a bed or a table, while the lower platform can be a desk, a credenza and desk, a davenport, a buffet, a dressing table, a bar, a credenza and chest or conference table, a piano, or table or desk in combination with a typewriter stand. In a first mode the upper platform is releasably locked in a prone position with the lower platform in a lowered position. Upon release of the lock a yieldable force urges the upper platform toward an upright position while the lower platform is conjointly moved in a horizontal attitude to a raised position.

The foregoing and additional objects and features of the invention will become apparent from the following description in which the preferred embodiments have been set forth in detail in conjunction with the accompanying drawings.

FIG. 3 is a side elevational view of the unit in the first mode.

FIG. 4 is a side elevational view of the unit in the second mode.

FIG. 5 is a fragmentary elevational view showing the yieldable force means taken along the line 5—5 of FIG. 4.

FIG. 6 is a fragmentary view, partially broken away, of the releasable lock means taken along the line 6—6 of FIG. 3.

Figure 1:
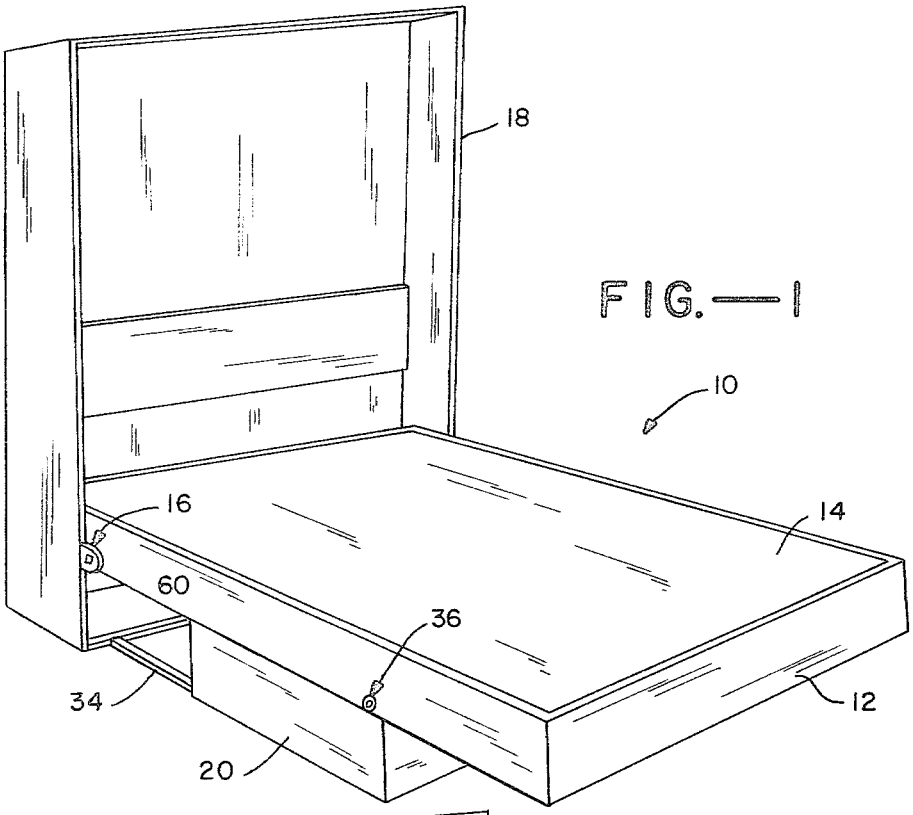
FIG. 1 is a perspective view of the convertible furniture unit of one embodiment of the invention shown in the first mode for use as a bed.
Figure 2:
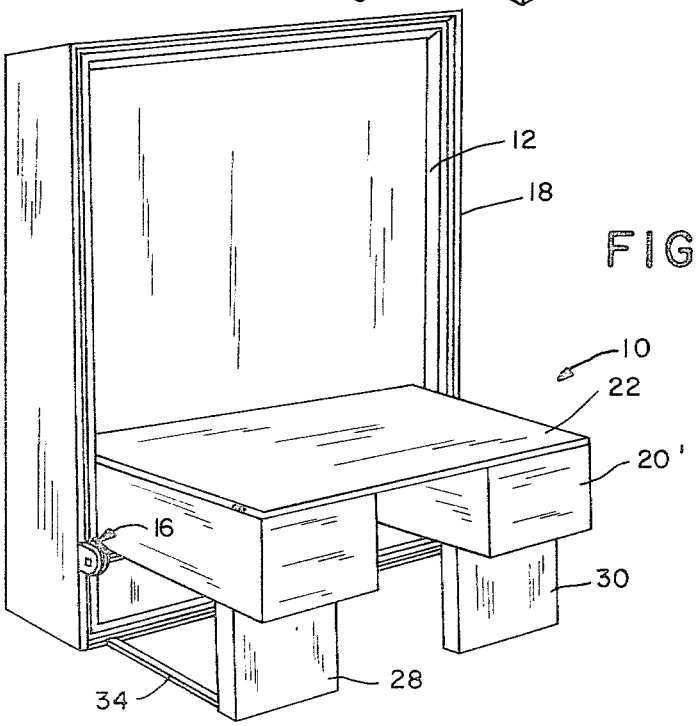
FIG. 2 is a perspective view of the furniture unit of FIG. 1 shown converted to the second mode for use as a desk.

In the drawings FIGS. 1–4 illustrate generally at 10 a convertible furniture unit according to one embodiment of the invention. Furniture unit 10 includes an upper platform comprising a bed frame 12 adapted for carrying a mattress 14. The bed frame is mounted for movement about a horizontal axis through a pair of fixed pivot connections 16, 17 on opposite sides of a support means. The support means comprises an upright housing 18 into which the frame and mattress pivot when they are raised to the upright position 12' illustrated in FIGS. 2 and 4. The housing 18 could also be formed by a recess in a wall behind the head of the bed frame.

Unit 10 further includes a lower platform comprising a desk 20 having a horizontally disposed upper desk surface 22, which could also be a work table surface. The desk is mounted through pivot connection 24 at an intermediate location along the opposite sides of the bed frame. The desk is also mounted through pivot connections 26 with a pair of legs 28, 30, the lower ends of which are mounted through pivot connections 32 with support arms 34 which project from the bottom of housing 18. The bed frame 12, desk 20, legs 28, 30, housing 18 and support arms 34 define a parallelogram linkage geometry which maintains a horizontal attitude of the desk as the unit is converted between a first or bed mode and a second or desk mode.

Releasable lock means is provided for releasably holding the bed frame and desk in their respective prone and lowered positions. The releasable lock means comprises a pair of lock units 36 provided on opposite sides of the bed frame and desk. Lock unit 36 is illustrated in greater detail in FIG. 6. The lock unit comprises a locking detent 38 mounted for axial sliding movement within a barrel 40 mounted in the side of the desk. The detent is yieldably urged outwardly of the desk by a spring 42 into engagement with a strike plate 44 attached to the inside of the bed frame in alignment with the detent. The distal end of the detent is bevelled to automatically move into engagement with the strike plate. A release button 46 is mounted within a socket in the bed frame and is yieldably urged by a spring 48 out of engagement with the detent. The distal end of the button projects outwardly from the bed frame so that it can be depressed by the user when it is desired to release the lock. When depressed the inner end of the button moves the detent out of engagement with the strike plate. When the buttons of both locks are depressed in this manner the frame is released from the desk.

Actuating means 50 is provided for automatically moving the bed frame and desk to their respective full upright and raised positions when the locks 36 are released. The actuating means comprises a pair of torsion bars 52, 54 which apply a yieldable force acting as a moment about the fixed pivots in a counterclockwise direction as viewed in FIG. 3. As best illustrated in FIG. 5 the proximal ends 56, 58 of the torsion bars are fixedly staked to support plates 60, 62 which are mounted on opposite sides of the housing. Each of the torsion bars freely extend through openings formed in movable plates 64, 66 which in turn are mounted on opposite lower sides of the bed frame 12. The distal ends 68, 70 of the torsion bars extend across the bed frame where they are fixedly mounted to opposite ones of the plates 64, 66. When the bed frame is pivoted down toward the prone position the torsion bars are twisted as a result of the pivoting of the movable plates relative to the fixed plates. This stores elastic energy in the torsion bars which is available for returning the bed frame and desk to their positions for the bed mode. In the bed mode the torsion bars are relaxed.

As best illustrated in FIG. 4 the geometry of the unit 10 is such that the bed frame and desk are held in their respective upright and raised position by gravity through the over center positioning of the pivot points. Thus, in the upright position the pivot point 24 between the bed frame and desk is positioned behind (i.e. toward the housing 18) a vertical plane extending through fixed pivot 16, while the pivot point 26 between the desk and leg 28 is also oriented behind a vertical plane extending through fixed pivot 32. The over center gravity force can be easily overcome to convert back to the desk mode by the individual pulling outwardly on either the bed frame or desk. As the bed frame reaches its prone position the two detents 38 of the locks automatically engage and lock with the respective strike plates carried on the inside of the bed frame.

Housing 18 is box-shaped to provide a recess with dimensions commensurate with the bed frame so that during the latters's upward movement the volume between the recess and the mattress traps an air pocket which cushions or dampens the bed frame to a stop. This cushioning effect obviates the need for mechanical stops and avoids damage which could arise from forcible contact or impact of the bed frame with the housing.

Figure 7:
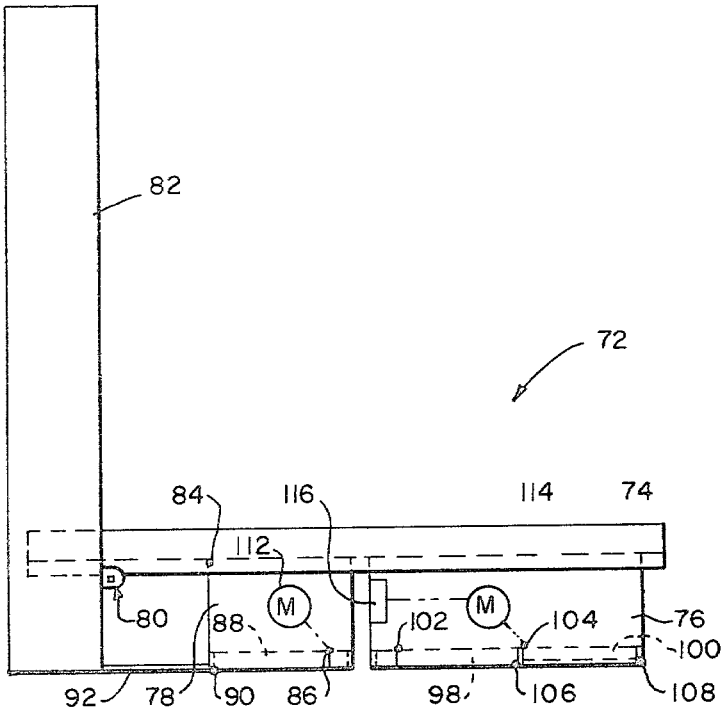
FIG. 7 is a side elevational view of another embodiment of the convertible furniture unit shown in the first mode for use as a bed.
Figure 8:
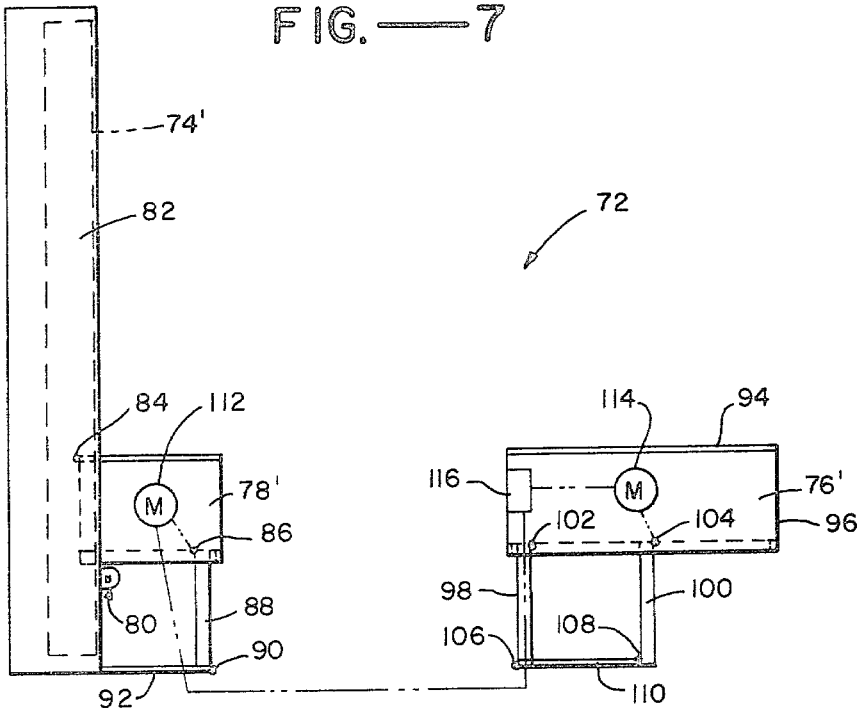
FIG. 8 is a side elevational view of the embodiment of FIG. 7 shown in the second mode for use as a desk.

FIGS. 7 and 8 illustrate another embodiment providing a furniture unit 72 having an upper platform comprising a bed frame 74 in combination with a lower platform comprising a desk 76 and credenza 78. Bed frame 74 is adapted to carry a mattress and is mounted at its proximal end through a fixed pivot 80 with upright housing 82. The housing is box-shpaed so that it forms an air pocket with the mattress to cushion upward movement of the bed frame in the manner described for the first embodiment.

The credenza 78 is mounted to opposite sides of the bed frame at pivot points 84. The lower end of the credenza is mounted through pivot points 86 to the upper ends of a pair of legs 88, the lower ends of which are mounted through pivot points 90 to support arms 92 which project from the base of the housing. The bed frame 74, credenza 78, legs 88, support arms 92 and housing 82 form a parallelogram geometry which maintains a level attitude of the credenza as it is moved between the lowered position illustrated in FIG. 7 and the raised position illustrated at 78' in FIG. 8. In the desk mode of FIG. 8 the pivot points 84 and 86 are oriented at an over center position (toward the housing) relative to the fixed pivots 80 and 90 so that the force of gravity holds the bed frame and credenza in their respective upright and raised positions in a manner similar to that explained for the first embodiment.

The desk 76 is located at a position separate from and forward of the credenza. Desk unit 76 includes an upper flat desk surface 94 mounted on a frame 96 which in turn is mounted on the upper ends of legs 98, 100 through pivot points 102, 104. The lower ends of the legs are mounted through fixed pivot points 106, 108 to a fixed support 110, which can be carried on the floor or other supporting surface. The pivot points between the desk and legs are both oriented forward (relative to the housing 82) of vertical planes passing through the respective fixed pivots so that the desk is held in its raised positon by the over center force of gravity acting in a clockwise direction as viewed in FIG. 8.

Motive means is provided for conjointly moving the credenza and bed frame together with the desk unit to the bed mode position as illustrated in FIG. 7. The motive means includes a first electric motor 112 mounted within credenza 78 and coupled through a suitable drive train to pivot connection 86 for causing the credenza and leg 88 to move back and forth through an arc of 90°. A second electric motor 114 is mounted within desk 76 and is coupled through a suitable drive train with pivot 104 for causing the desk and leg 100 to move back and forth through a 90° arc. The pivots 80, 102 and 104 can include torsion bar arrangements as in the first embodiment to assist the motors in moving the bed frame and credenza.

A suitable control circuit 116 is provided for synchronizing the two motors 112 and 114 so that the bed frame, credenza and desk move conjointly between their bed and desk modes. Thus, when initially in the desk mode of FIG. 8, motor 112 is energized by the control circuit, e.g. by an on-off switch, to cause credenza 78 and arm 88 to move through an arc toward each other so that arm 88 pivots clockwise as viewed in FIG. 8. At the same time motor 114 is energized by the circuit to cause relative movement between arm 100 and desk 76 so that the arm moves counterclockwise as viewed in FIG. 8. The motors are synchronized so that by the time the desk moves to its lowered position of FIG. 7 the bed frame 74 has reached its prone position overlying both the credenza and desk. Operation of the control circuit to actuate the motors in reverse direction moves the credenza, bed frame and desk units back to the desk mode.

Furniture unit 72 could also be constructed with a fixed low table, equal in height to the top of the desk in the position of FIG. 7, in place of the desk so that the table serves as a pedestal for the bed when the latter is lowered. In addition, where the motor 112 is not employed the credenza 78 could be provided with a locking mechanism, similar to the lock unit 36, FIG. 6, for locking the credenza to the bed when in the bed mode.

The invention contemplates that the upper and lower platforms could be comprised of different furniture devices arranged in varying combinations for multi-purpose activities. For example, where the upper platform provides a bed as previously described, the lower platform could comprise a sofa or davenport seat that acts as the bed pedestal. The back of the davenport would be attached to the bed frame and would rest on the seat when the bed is in the prone position.

In another arrangement contemplated by the invention an upper platform comprising a bed would be in combination with a lower platform comprising a lower hinged table in combination with a separate table which acts as a pedestal. The lower hinged table would function as a buffet similarly to the previously-described credenza of FIGS. 7 and 8 and would contain the locking devices of FIG. 6. The separate table similar to the desk of FIGS. 7 and 8 would act as a pedestal and could either be a low level cocktail table or a variable height table, e.g. a standard 28" high table, which lowers to a cocktail level to act as the pedestal.

Another arrangement contemplated by the invention would be a unit in which the upper platform comprises a bed and the lower platform comprises a dressing table arranged similarly to the previously-described credenza of FIGS. 7 and 8 and which would contain the locking devices. A separate cocktail table arranged similarly to the separate desk unit described in the embodiment of FIGS. 7 and 8 could be provided to act as a pedestal for the bed.

Another arrangement contemplated by the invention would be an upper platform comprising a bed at a height, when lowered, of 23" and with a lower platform comprising a dry bar or stereo cabinet arranged similarly to the previously-described credenza of FIGS. 7 and 8 and containing the locking devices. A separate cocktail table arranged similarly to the separate desk unit described in the embodiment of FIGS. 7 and 8 could be provided to act as a pedestal for the bed.

Another arrangement contemplated by the invention would include an upper platform which comprises a table at a height, when lowered, on the order of 28".The lower platform would include a dry bar arranged similarly to the previously-described credenza of FIGS. 7 and 8 and which contains the locking devices. A lower level cocktail table arranged similarly to the separate desk of the embodiment of FIGS. 7 and 8 would act as the pedestal for the table.

Another arrangement of the invention would be a unit in which the upper platform comprises a conference table at a standard 28" height when in the prone position. The lower platform would comprise either a chest or credenza which would be at a 30–32" height elevation when raised and would move to a lower level when lowered to act as the platform for the conference table, with the lower platform also containing the locking devices.

Another arrangement of the invention would be an upper platform comprising a bed and a lower platform comprising a piano hinged to the bed frame in a manner similar to the attachment of the desk in the embodiment of FIG. 1. The piano legs and pedals would be hinged and permit the piano to move to the lowered position and act as a pedestal for the bed.

A further arrangement contemplated by the invention would be an upper platform comprising a bed and a lower platform comprising either a table or desk hinged similarly to the embodiment of FIG. 1 but in which the table or desk is positioned to one side of the bed. The space at the other side of the bed accommodates a typewriter stand fixedly attached to the bottom of the bed frame so that the attitude of the typewriter would be perpendicular to the floor when the bed is in the prone position.

While the foregoing embodiments are at present considered to be preferred it is understood that numerous variations and modifications may be made herein by those skilled in the art and it is intended to cover in the appended claims all such variations and modifications as fall within the true spirit and scope of the invention.

What is claimed is:

1. A convertible furniture unit comprising the combination of an upper platform for use as a bed or table, a lower platform, support means for mounting the upper platform for movement about a horizontal axis between an upright position and a prone position, the support means including an upstanding housing upon which the upper platform is pivotally mounted together with leg means upon which the lower platform is pivotally mounted, said upper platform being pivotally mounted with the lower platform in parallelogram linkage geometry with the leg means and housing for maintaining a horizontal orientation of the lower platform throughout its movement, said upper platform when in the prone position holding the bed or table horizontally for use in a first mode, said support means further mounting the lower platform for movement between a raised position for use in a second mode when the upper platform is upright and a lower position when the upper platform is prone, with the points of pivotal connection between the upper and lower platforms and between the lower platform and leg means at an overcenter position with respect to the points of connection of the upper platform and leg means to the support means, respectively, in the second mode whereby the force of gravity holds the upper and lower platforms in the respective upright and raised positions, means for releasably locking the upper platform in its prone position, and actuating means for applying a yieldable force urging the upper platform toward its upright position whereby upon release of the locking means the yieldable force moves the upper platform toward the upright position, and whereby another force applied on the upper platform counter to the yieldable force moves it toward the prone position for engagement of the releasable lock.

2. A furniture unit as in claim 1 which includes releasable lock means for holding the upper and lower platforms in their respective prone and lowered positions while the actuating means continues to apply the yieldable force whereby upon release of the lock means the yieldable force is immediately effective for moving the upper platform toward the upright position.

3. A furniture unit as in claim 1 in which the lower platform comprises a credenza together with a low level fixed table spaced apart from the credenza and forming a pedestal for the upper platform when in the first mode.

4. A convertible furniture unit comprising the combination of an upper platform comprising a bed frame for holding a mattress, a lower platform including a desk, support means for mounting the bed frame for movement about a horizontal axis between an upright position and a prone position, the support means including an upright housing upon which the bed frame is pivotally mounted together with the first leg means for mounting the desk at a position spaced apart from the housing, and including a credenza pivotally mounted on the bed frame, with the support means further including second leg means pivotally mounted on the credenza in parallelogram geometry for supporting the credenza in horizontal attitude during movement of the bed frame, said upper platform when in the prone position holding the bed horizontally for use in a first mode, said support means further mounting the lower platform for movement between a raised position for use in a second mode when the upper platform is upright and a lower position when the upper platform is prone, said support means maintaining a horizontal orientation of the lower platform throughout its movement, means for releasably locking the upper platform in its prone position, and actuating means for applying a yieldable force urging the upper platform toward its upright position whereby upon release of the locking means the yieldable force moves the upper platform toward the upright position, and whereby another force applied on the upper platform counter to the yieldable force moves it toward the prone position for engagement of the releasable lock.

5. A furniture unit as in claim 4 in which the points of pivotal connection of the credenza to the bed frame and to the second leg means as well as the points of pivotal connection between the desk and first leg means are at an over center position during the second mode whereby gravity force holds the credenza and bed frame in the upright position and further holds the desk in the raised position.

6. A furniture unit as in claim 5 in which the actuating means includes motor means for moving the credenza and bed frame between upright and prone positions and for moving the desk between the raised and lowered positions, together with control means for synchronizing said motor means whereby the desk is moved to the raised or lowered positions when the bed frame and credenza are moved to the upright or prone positions, respectively.

* * * * *